United States Patent [19]

Tolsma

[11] Patent Number: 4,778,174

[45] Date of Patent: Oct. 18, 1988

[54] POLE VAULT SIMULATOR DEVICE

[76] Inventor: Brant Tolsma, 509 Willow Oak Ter., Forrest, Va. 24551

[21] Appl. No.: 90,536

[22] Filed: Aug. 28, 1987

[51] Int. Cl.[4] ..... A63B 5/16

[52] U.S. Cl. ..... 272/101; 272/93

[58] Field of Search ..... 272/100, 101, 93, 61, 272/109, 85, 90, 91, 104, 110–113, 900, 120, 72

[56] References Cited

U.S. PATENT DOCUMENTS

| | | | |
|---|---|---|---|
| 1,907,451 | 5/1933 | Sibley | 272/110 |
| 2,107,377 | 2/1938 | Howland | 272/109 |
| 3,012,778 | 12/1961 | Whittaker et al. | 272/104 |
| 3,825,252 | 7/1974 | Geiger | 272/109 X |
| 4,017,070 | 4/1977 | Hilton | 272/104 |
| 4,449,716 | 5/1984 | Goldy et al. | 272/61 X |

FOREIGN PATENT DOCUMENTS

| | | | |
|---|---|---|---|
| 150850 | 9/1981 | German Democratic Rep. | 272/72 |
| 218733 | 2/1985 | German Democratic Rep. | 272/72 |
| 2639882 | 9/1978 | Fed. Rep. of Germany | 272/72 |
| 1003859 | 3/1983 | U.S.S.R. | 272/109 |

*Primary Examiner*—Richard J. Apley
*Assistant Examiner*—Howard Flaxman
*Attorney, Agent, or Firm*—Richard C. Litman

[57] ABSTRACT

The invention relates to an improvement in training devices, in particular, training devices for the pole vault exercise. The apparatus propels a person into the air, and after obtaining the desired point of inertia, provides support for projecting the person beyond this point of inertia. The apparatus therefore simulates the pole vault procedure, wherein, the approach to the clearance bar is eliminated, the pole and the athlete are propelled vertically from a lower, more horizontal position to a higher, more vertical position, thereby, providing a safe, efficient, and effective tool for mastering the "in-flight" technique of the pole vault acitvity.

4 Claims, 4 Drawing Sheets

Fig. 7
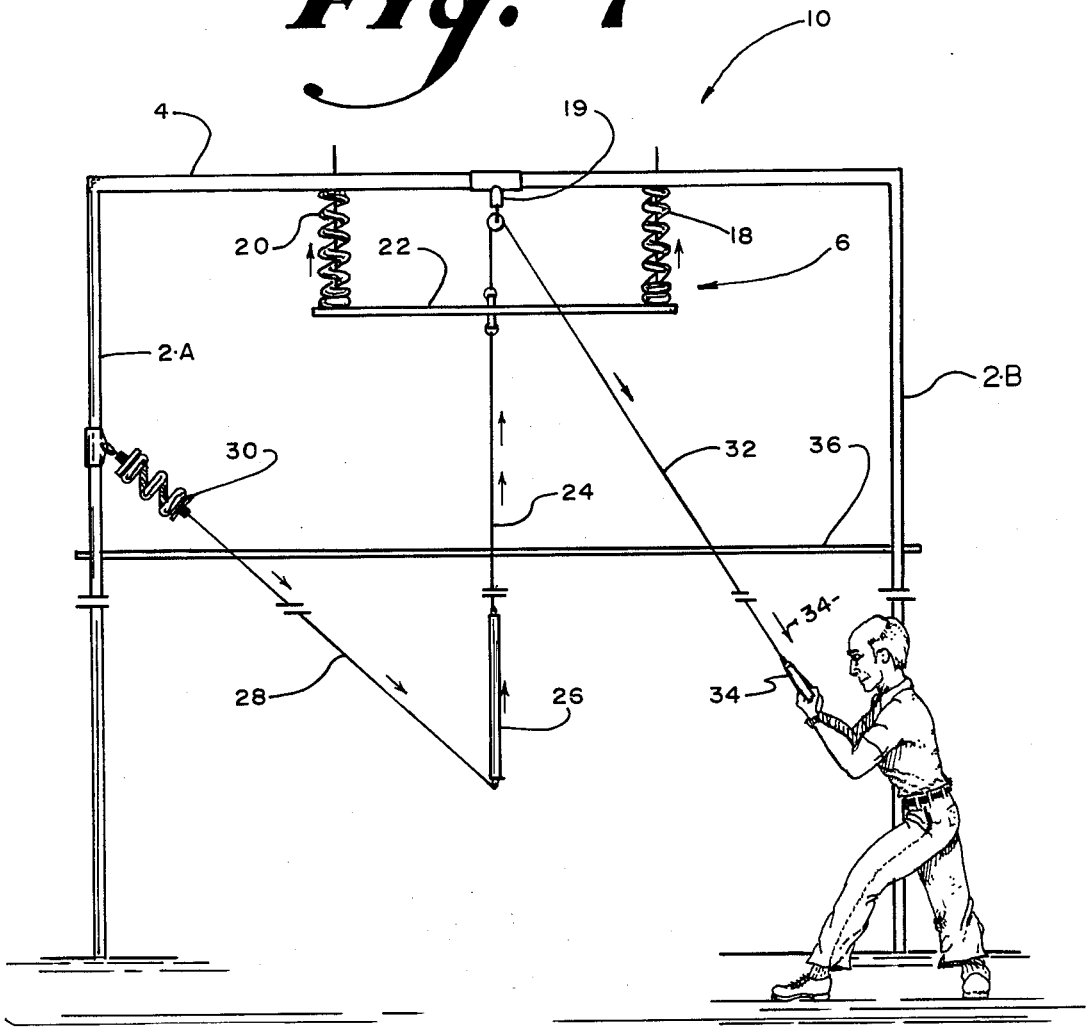
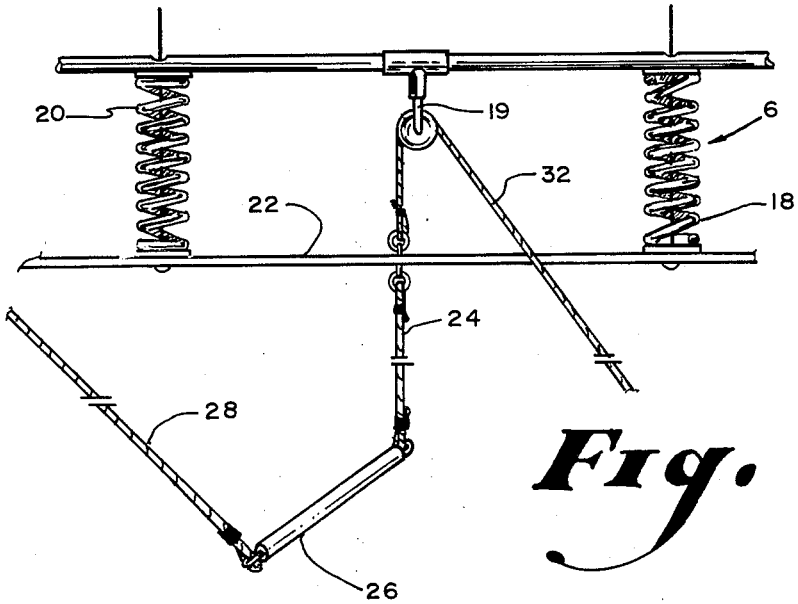
Fig. 8

POLE VAULT SIMULATOR DEVICE

BACKGROUND OF THE INVENTION

The pole vault exercise is one of the most difficult events to master in track and field. The event consists of two parts, these being:

(1) The approach and takeoff; the athlete sprints toward the bar, he then plants a pole into the box thereby propelling himself in the air.

(2) The "rock-back" and clearance; the athlete swings to an upside down position. As he accelerates towards the horizontal clearance bar, he then re-aligns his body, so that he is facing the bar. He then uses the pole for leverage to facilitate clearing the bar.

The present invention lends itself to mastering the second, and most difficult part, or technique involved in the exercise.

There are various reasons why this technique cannot be easily learned and practiced in a recurring manner, these being:

(1) The athlete, being in the air, and oriented in an unfamiliar position, may tend to be apprehensive, and therefore cannot concentrate on the technique.

(2) The first part of the exercise, or the approach is both time consuming and energy depriving, and lends itself to a lack of concentration on the second part of the exercise, (3) The proper positioning and orientation of the athlete cannot be aided by a coach or assistant, if the exercise is done in a continuous procedure, i.e. from the approach to the clearing of the bar.

The lack of practicing the aforementioned technique in this manner, lends itself to a lack of mastering the finer and more intricate points of the pole vault technique.

DESCRIPTION OF THE PRIOR ART

A variety of devices are found that disclose teaching or training aides related to gymnastics and pole vaulting in particular. The following U.S. patents are exemplary of the prior art.

| U.S. Pat. No. | Inventor |
|---|---|
| 4,017,070 | Hilton |
| 3,012,778 | Whittaker |
| 1,907,451 | Sibley |

U.S. Pat. No. 4,017,070 to Hilton discloses a training device for pole vaulters. It comprises a pair of collars able to slide on or off of a vaulting pole, which would show a vaulter proper hand placement.

U.S. Pat. No. 3,012,778 to Whittaker discloses a gymnastic apparatus comprising a socket, which is adapted to receve the lower end of a vaulting pole. The socket contains resilient material which is compressible by the vaulting pole when inserted into the socket. The device is installed in the ground in place of the usual socket.

U.S. Pat. No. 1,907,451 to Sibley discloses an amusement device designed to provide safe play, or recreation. It comprises a single pole ladder, mounted on a spring loaded pivot.

These patents or known prior art uses, teach and disclose various examples of training apparatus for athletes, especially pole vaulters, and the like, as well as methods of their construction; but none of them, whether taken singly or in combination, disclose the specific details of the combination of the invention in such a way as to bear upon the claims of the present invention.

The present invention discloses, a novel apparatus and its use, whereby an athlete is able to practice the most demanding technique of the pole vault routine, i.e. the ""rock-back" and clearance of the bar", without having to attempt the "approach" to the bar.

SUMMARY OF THE INVENTION

The primary object of the present invention is to provide an apparatus for mastering the second part of the pole vaulting technique, whereby an apparatus is constructed to simulate the mechanics of this particular part of the pole vault procedure.

Furthermore, the apparaus lends itself to the elimination of the approach procedure, and concentrates on mastering the clearance, or "in-flight" technique of the exercise.

It is still a further object of the invention to allow the athlete to master the aforementioned technique, whereby he swings to an inverted position, causing the pole to descend and obtain an approximate 45 degree angle with the vertical axis, he is then hoistered upward as the simulated pole with the athlete is moved from the approximate 45 degree angle with the vertical axis, to a near parallel alignment with the vertical axis, thus simulating the dynamics of the "rock-back" and clearance, a very critical phase of the pole vault routine.

This device can be used in a number of environments, including outdoor or indoor track facilities and other restricted areas, such as gymnasiums and the like.

These, together with other objects and advantages of the invention, reside in the details of the process and the operation thereof, as is more fully hereinafter described and claimed. References are made to drawings forming a part hereof, wherein like numerals refer to like parts throughout.

DESCRIPTION OF THE DRAWINGS

FIG. 7 is front elevation view illustrating an assistant applying the required additional force at a second hand grip member.

FIG. 8 is an enlarged view of the retracting-elastic assembly and first hand grip member of FIG. 7.

DESCRIPTION OF THE PREFERRED EMBODIMENT

Figure 1:
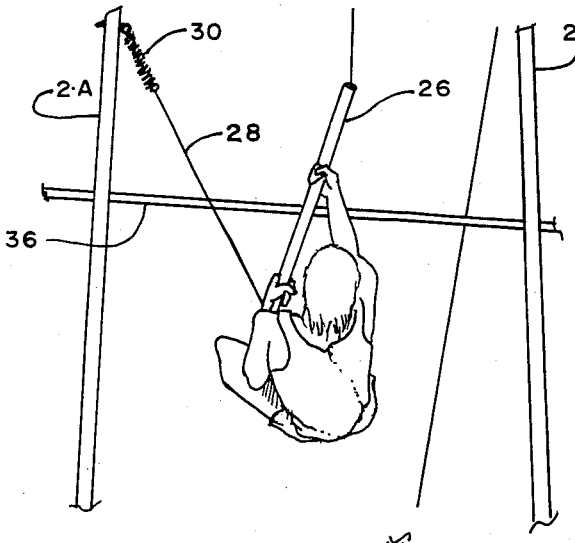
FIGS. 1 through 3 are front elevational views of the apparatus in its preferred embodiment illustrating the athlete grasping the first hand grip member, jumping into the air, then realigning his body into an inverted position, while stretching the spring members of FIGS. 7 and 8, then being propelled upwardly, and over a horizontal clearance bar.
Figure 2:
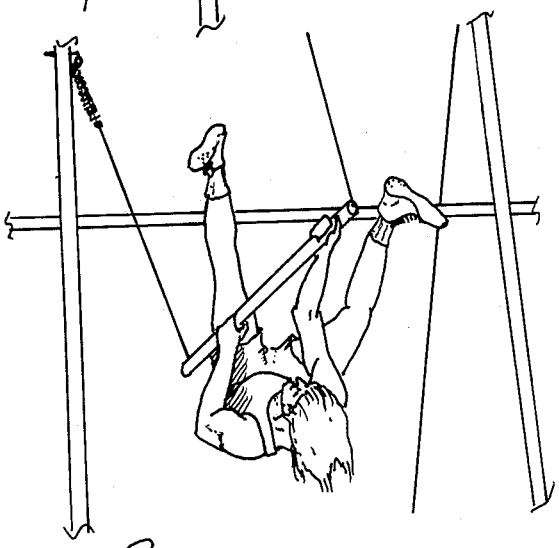
Figure 3:
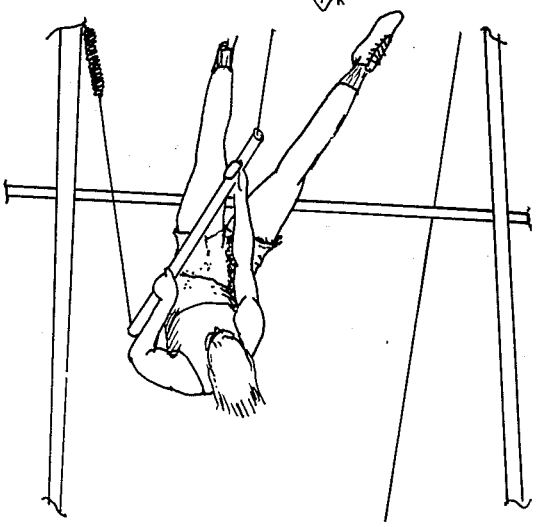
Figure 4:
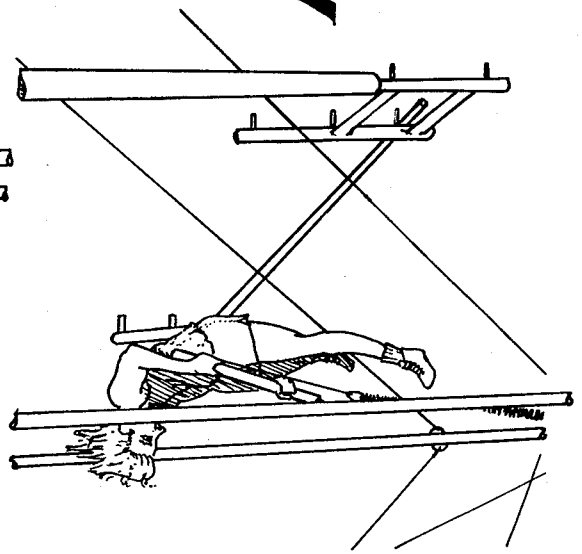
FIGS. 4 and 5 are perspective views of the preferred embodiment further illustrating the progressively upward orientation of the athlete.
Figure 5:
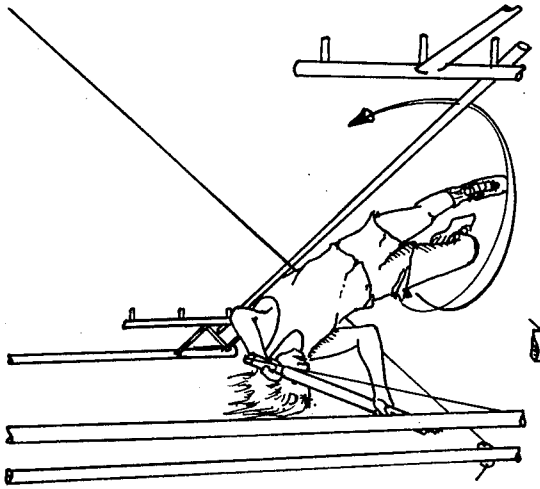

Referring now to the drawings, FIGS. 7 and 8 show a support means located about the periphery of the device 10, seen here comprising a rigid horizontal member 4 and two rigid vertical members 2A and 2B.

As seen in FIG. 8, the rigid horizontal member 4 has means for attaching a retracting-elastic assembly 6, said retracting-elastic assembly 6 comprising two tension devices, such as springs 18 and 20. The retracting-elastic assembly 6 also has means for attaching a rigid transverse member 22 to said tension attaching one end of a flexible cable 24. The flexible cable 24 has means for pivotably attaching a first hand grip member 26 to its opposite end, said first hand grip member 26 having gripping means for propelling the person upwardly, said first hand grip member 26 also having means for pivotably attaching a second flexible cable 28 on its opposite end, said second flexible cable 28 also having means for pivotably attaching a tension device 30, said tension device 30 being similar to tension devices 18 and 20, with tension device 30 being more compact and having a greater stiffness coefficient than tension devices 18 and 20, said tension device 30 serving to change the orientation of the pole as it rises.

An additional force is applied to said retracting-elastic assembly 6 to propel the person upward; said additional force comprises a third flexible cable 32, attached at one end to said retracting-elastic assembly 6 by means of said rigid transverse member 22, and attached on the opposing end to a second hand grip member 34, such that said additional propelling force may be manually facilitated. A pulley 19 is attached to said rigid horizontal member 4, whereby said third flexible cable 32 may be transversely fed across said pulley 19, said pulley 19 operable to change the direction of the additional force, such that the additional force may be facilitated from ground level.

Referring now to FIGS. 1 through 7, a person grasps the first hand grip member 26, jumps upward and, realigns himself into an upside down position. As he begins to drop backward, he applies a given load on the retracting-elastic assembly 6 at said first hand grip member 26, thereby producing a strain or elastic force on the retracting-elastic assembly 6.

As seen in FIG. 7, along with the force developed in the retracting-elastic assembly during the change from potential to kinetic energy, an additional force is applied in the direction of 34A, thereby supplying additional kinetic energy to the retracting-elastic assembly 6, and producing the required force to propel the person into the air.

Figure 6:
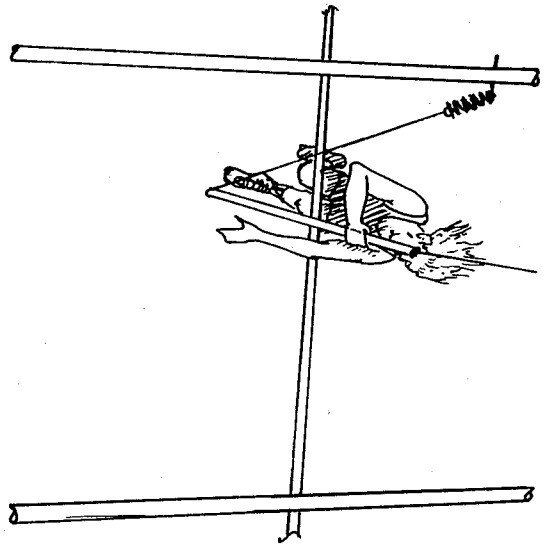
FIG. 6 is an elevation view illustrating the athlete "clearing" a horizontal bar while using the simulated pole to project himself beyond a given point.
Figure 9:
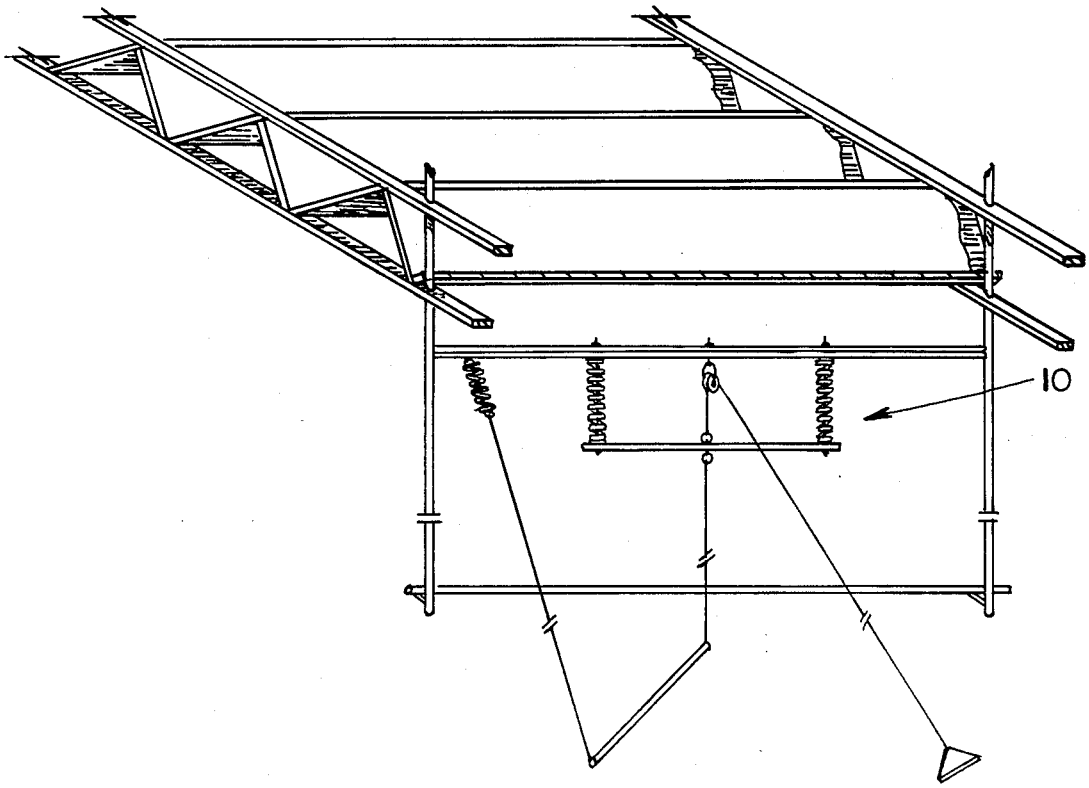
FIG. 9 is an alternate embodiment illustrating both the tension device and the retracting-elastic assembly of the apparatus attached to a ceiling.

As seen in FIG. 6, upon reaching the desired point of inertia, said person realigns his body and uses the first hand grip member 26 to provide the projecting force to move beyond the point of inertia, and over the horizontal clearance bar 36.

During the phase change from potential to kinetic energy, the tension device 30 and the flexible cable 28 facilitate propelling the pole vertically from a lower, more horizontal position to a higher, more vertical position, thus simulating the mechanics of the pole, during the second part of the pole vault event.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, fall within the scope of the invention.

What is claimed is:

1. An apparatus for propelling a person upward and projecting the person beyond a point of inertia comprising;

a retracting-elastic assembly for propelling a person upward, additional means for propelling the person upward, attached to said retracting-elastic assembly, a rigid horizontal member, means for attachment of said rigid horizontal member to said retracting-elastic assembly, said rigid horizontal member serving as support means for both the propelling force and the additional propelling force, a first hand grip member pivotably joined at one end to said retracting-elastic assembly by a first flexible cable, said first hand-grip member comprising gripping means for the person as he is propelled upwardly, a elastic tension device pivotably joined at one end to the opposing end of said first hand grip member by a second flexible cable, said elastic tension device and the second flexible cable serving to facilitate the propelling of the vertical member vertically from a lower, more horizontal position to a higher, more vertical position, said elastic tension device being more compact and having a greater stiffness coefficient than that of said retracting assembly, a rigid vertical member, means for attachment of said rigid vertical member to said tension device, said rigid vertical member serving as the support means for the projecting force, whereby a person will be propelled upward and projected beyond a desired point of inertia, thus simulating the second part of the pole vault technique.

2. An apparatus as described in claim 1 wherein, said retracting-elastic assembly comprises;

a first spring member and a second spring member attached to said rigid horizontal member, said first and second spring members also attached to a rigid transverse member on their opposing ends, said spring members providing the means for the upwardly propelling force of the retracting-elastic assembly.

3. An apparatus as described in claim 1 wherein, said additional means for propelling the person upwardly comprises;

a third flexible cable attached at one end to said retracting-elastic assembly, and attached on the opposite end to a second hand grip member, such that said additional propelling force may be manually facilitated, a pulley attached to said rigid horizontal member having said third flexible cable transversely fed across said pulley, said pulley operable to change the direction of the additional force, such that the additional force may be facilitated from ground level.

4. A method for using the apparatus as described in claim 1 comprising:

said person jumping upward, grasping the first hand grip member and realigning himself into an upside down position, thereby applying a given load on the retracting-elastic assembly at said first hand grip member, thereby producing a kinetic energy factor in said retracting-elastic assembly, applying an additional force on the retracting-elastic assembly at the second hand grip member, thus supplying additional kinetic energy to the retracting-elastic assembly, and producing the required force to propel the person upward, upon reaching the desired point of inertia, said person realigning his body and using said first hand grip member to provide the projecting force to move beyond the point of inertia, whereby during the phase change from potential to kinetic energy, said elastic tension device and said second flexible cable facilitate propelling said person vertically from a lower position in front of a horizontal clearance bar, to a higher position over said bar, thus simulating the second part of the pole vault technique.

* * * * *